US011272585B2

(12) United States Patent
Fryshman

(10) Patent No.: US 11,272,585 B2
(45) Date of Patent: Mar. 8, 2022

(54) SELF-STIRRING INDUCTION VESSEL

(71) Applicant: Bernard Fryshman, Brooklyn, NY (US)

(72) Inventor: Bernard Fryshman, Brooklyn, NY (US)

(73) Assignee: Bernard Fryshman, Flushing, NY (US)

( * ) Notice: Subject to any disclaimer, the term of this patent is extended or adjusted under 35 U.S.C. 154(b) by 0 days.

(21) Appl. No.: 16/667,976

(22) Filed: Oct. 30, 2019

(65) Prior Publication Data

US 2021/0136881 A1 May 6, 2021

(51) Int. Cl.

| | |
|---|---|
| ***H05B 6/34*** | (2006.01) |
| ***H05B 6/12*** | (2006.01) |
| ***H05B 6/04*** | (2006.01) |
| ***H05B 6/06*** | (2006.01) |

(52) U.S. Cl.

CPC ..... *H05B 6/34* (2013.01); *H05B 6/04* (2013.01); *H05B 6/06* (2013.01); *H05B 6/12* (2013.01)

(58) Field of Classification Search

CPC ..... H05B 6/04; H05B 6/06; H05B 6/12
USPC ..... 219/635
See application file for complete search history.

(56) References Cited

U.S. PATENT DOCUMENTS

| | | | | |
|---|---|---|---|---|
| 8,241,390 | B2 * | 8/2012 | Koch | B22D 41/01 75/10.15 |
| 9,510,398 | B1 * | 11/2016 | Miller | H05B 6/1209 |
| 9,618,210 | B2 * | 4/2017 | Lee | F24C 7/083 |
| 2015/0316394 | A1 * | 11/2015 | Kim | G01R 33/10 324/207.2 |
| 2015/0319812 | A1 * | 11/2015 | Fryshman | H05B 6/06 219/621 |

* cited by examiner

*Primary Examiner* — Ibrahime A Abraham
*Assistant Examiner* — Kuangyue Chen
(74) *Attorney, Agent, or Firm* — Bell & Manning, LLC

(57) ABSTRACT

A self-stirring induction system includes a vessel that has a plurality of ferromagnetic elements. The system also includes an electromagnetic radiation source that is positioned to deliver electromagnetic radiation to the plurality of ferromagnetic elements. The system further includes a controller in communication with the electromagnetic radiation source. The controller is configured to determine, based at least in part on a desired amount or type of stirring, a pattern in which to heat the plurality of ferromagnetic elements. The controller is also configured to cause the electromagnetic radiation source to target the plurality of ferromagnetic elements with radiation in the determined pattern to induce a convection current in contents of the vessel such that the desired amount or type of stirring occurs.

19 Claims, 6 Drawing Sheets

SELF-STIRRING INDUCTION VESSEL

BACKGROUND

Induction heating is a form of heating that utilizes an electromagnetic (EM) radiation source to heat a ferrous metal from within, as opposed to an open flame or heating element that heats via conduction. Traditional induction heating is used for food preparation, and involves using a ferrous cooking vessel placed in close proximity to an EM radiation source. Upon activation, the EM radiation source emits EM waves that cause the ferrous cooking vessel to heat up, which in turn heats the contents of the ferrous cooking vessel via conduction of the heat from the cooking vessel to its contents.

SUMMARY

An illustrative self-stirring induction system includes a vessel that has a plurality of ferromagnetic elements. The system also includes an electromagnetic radiation source that is positioned to deliver electromagnetic radiation to the plurality of ferromagnetic elements. The system further includes a controller in communication with the electromagnetic radiation source. The controller is configured to determine, based at least in part on a desired amount or type of stirring, a pattern in which to heat the plurality of ferromagnetic elements. The controller is also configured to cause the electromagnetic radiation source to target the plurality of ferromagnetic elements with radiation in the determined pattern to induce a convection current in contents of the vessel such that the desired amount or type of stirring occurs.

An illustrative method for self-stirring includes receiving, by a processor of a controller, a desired amount or type of stirring to perform on contents of a vessel. The method also includes determining, by the processor of the controller and based at least in part on the desired amount or type of stirring, a pattern in which to heat a plurality of ferromagnetic elements that are positioned about the vessel. The method further includes causing, by the processor, an electromagnetic radiation source to target the plurality of ferromagnetic elements with radiation in the determined pattern to induce a convection current in the contents of the vessel such that the desired amount or type of stirring occurs.

Other principal features and advantages of the invention will become apparent to those skilled in the art upon review of the following drawings, the detailed description, and the appended claims.

BRIEF DESCRIPTION OF THE DRAWINGS

Illustrative embodiments of the invention will hereafter be described with reference to the accompanying drawings, wherein like numerals denote like elements.

DETAILED DESCRIPTION

In traditional cooking, it is often desirable to stir the contents of a cooking vessel (e.g., pot, pan, wok, etc.) to help heat the contents evenly and to prevent burning. However, constant stirring is time consuming and often prevents the cook from performing other tasks in the kitchen or elsewhere. Described herein is a self-stirring induction vessel, which can be a cooking vessel or any other type of vessel in which contents are to be heated or stirred. In an illustrative embodiment, the self-stirring induction vessel is made from a non-ferrous material and includes a plurality of ferrous elements positioned about the vessel. One or more electromagnetic radiation sources are used to target the ferrous elements in a pattern that results in agitation (i.e., stirring) of the contents of the vessel via targeted induced convection currents that result from heating.

Figure 1:
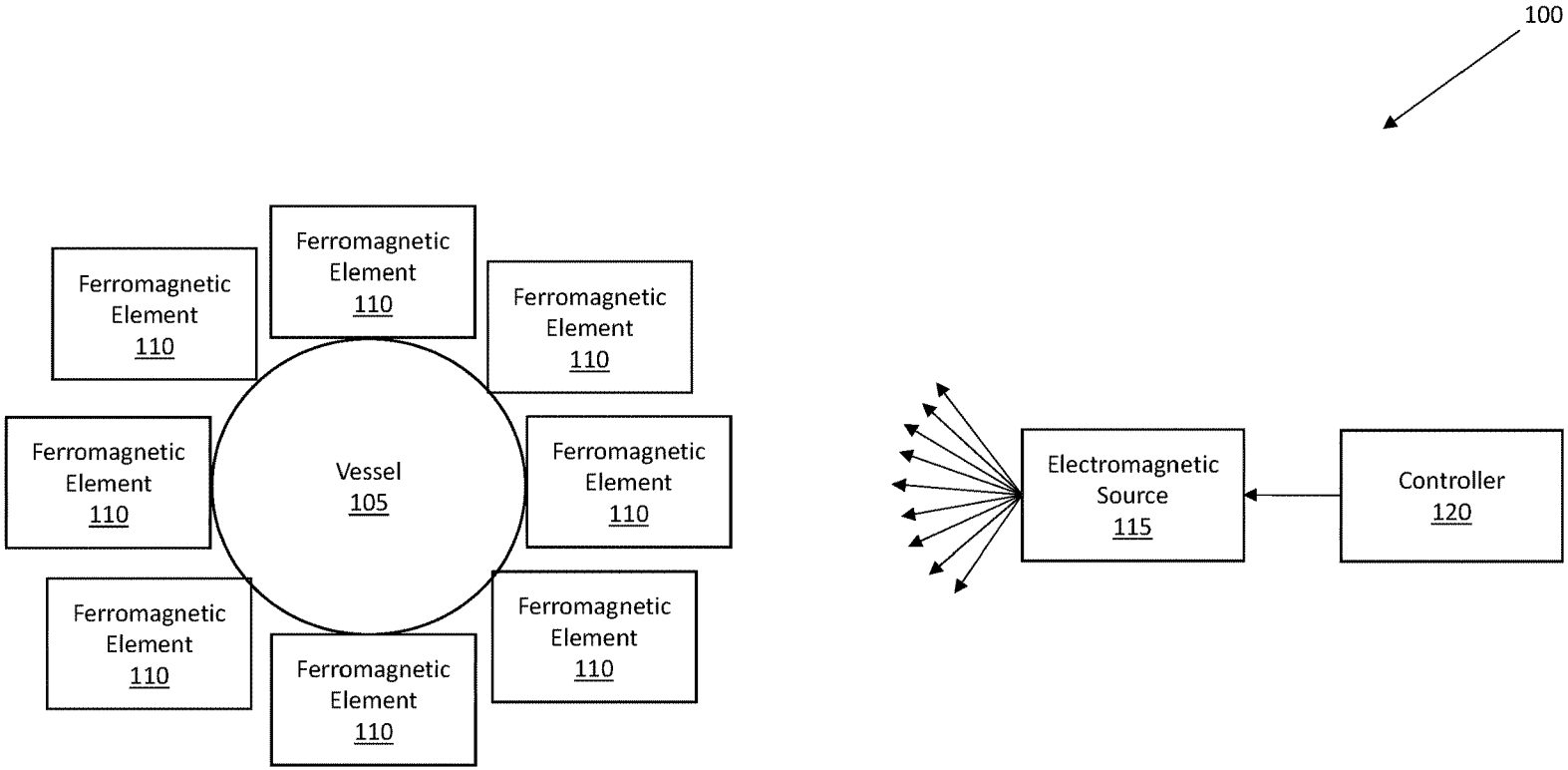
FIG. 1 depicts a self-stirring induction system in accordance with an illustrative embodiment.

FIG. 1 depicts a self-stirring induction system 100 in accordance with an illustrative embodiment. The self-stirring induction system 100 includes a vessel 105, a plurality of ferromagnetic elements 110 positioned about the vessel 105, an electromagnetic source 115, and a controller 120. In alternative embodiments, the self-stirring induction system 100 can include fewer, additional, and/or different elements. For example, in one embodiment, the system 100 can include a plurality of electromagnetic sources.

The vessel 105, although shown as having a circular shape profile (i.e., cylinder), can have any other shape profile, including square (i.e., cube), rectangular (parallelepiped), octagonal, etc. In an illustrative embodiment, the vessel 105 is made from non-ferromagnetic material such as wood, plastic, rubber, copper, aluminum, etc. As a result, radiation from the electromagnetic source 115 does not directly heat the vessel 105. The plurality of ferromagnetic elements 110 are made from ferromagnetic material and are used to heat the vessel 105 and/or its contents. Although 8 ferromagnetic elements 110 are shown for illustrative purposes, it is to be understood that fewer or additional ferromagnetic elements may be used, such as 1, 2, 4, 16, 32, 64, etc.

In an illustrative embodiment, the ferromagnetic elements 110 are positioned about the vessel 105. For example, the ferromagnetic elements 110 can be positioned on an inner surface (e.g., sidewall(s) and/or bottom wall) of the vessel 105, on an outer surface of the vessel 105, in one or more slots formed between inner and outer sidewalls of the vessel 105, in one or more slots formed between inner and outer bottom walls of the vessel 105, on a lid of the vessel 105, etc. Various configurations of the ferromagnetic elements are depicted and described with reference to FIG. 2. The ferromagnetic elements 110 can all have the same shape and/or size in one embodiment. Alternatively, the ferromagnetic elements 110 can vary in shape and/or size.

The ferromagnetic elements 110 are configured to receive radiation from the electromagnetic source 115. The ferromagnetic elements 110 that receive the radiation heat up due to generated eddy currents therein. This heat is transferred to the vessel 105 and/or its contents to heat the contents via conduction. As it is heated, each ferromagnetic element therefore releases heat energy into the contents of the vessel 105, and this heat energy causes agitation to the contents via the resulting convection current. By heating the ferromagnetic elements in a circular, spiral, or other pattern about the vessel 105, this agitation is aggregated to result in stirring of the contents of the vessel 105.

The controller 120 is used to control the electromagnetic source 115 to target the desired pattern of the ferromagnetic elements 110 (and thus the desired stirring pattern). The controller 120, which is described in more detail below, can be a computing system that includes a processor, memory, user interface, etc. In some embodiments, the ferromagnetic elements 110 can be uniformly positioned about the vessel 105, and the vessel 105 can be positioned in a location and orientation that is known to the controller 120. For example, the vessel 105 may be positioned in a holder or marked location of a cooktop surface. The controller 120 can also be programmed to know the locations of the ferromagnetic elements positioned about the vessel 105. As a result, the controller 120 can cause the electromagnetic source 115 to target the ferromagnetic elements 110 in a sequential order (or pattern) to induce stirring.

In an alternative embodiment, the controller 120 can be configured to communicate with the ferromagnetic elements 110 to identify their locations. For example, each of the ferromagnetic elements can include a heat resistant tag (or other transceiver) that is designed to send a wireless response to the controller 120 in response to a received signal from the controller 120. The wireless response from each ferromagnetic element can include an identifier of the ferromagnetic element and/or a position of the ferromagnetic element in/on the vessel 105. For example, in an embodiment in which the ferromagnetic elements 110 are statically positioned about the vessel 105, the tag (or other transmitter) can include a memory that stores its position in the vessel 105, and transmits the position in the wireless response to the prompt from the controller 120. In such a static embodiment in which the ferromagnetic elements remain in the same position, the positions of each ferromagnetic element and its corresponding identifier can be stored in a memory of the controller 120, and the controller 120 can determine the position based on the identifier received from the element in the wireless response. In some embodiments, the controller 120 can determine the location of a ferromagnetic element by analyzing the wireless response from the tag using triangulation or any other location determination technique.

In another embodiment, the ferromagnetic elements can be positioned about the vessel 105 in a desired configuration by the user. For example, the vessel 105 can include hooks or other appendages on an interior or exterior wall on which the user can hang ferromagnetic elements. The vessel 105 may also include slots between an inner wall and outer wall (either side wall or bottom wall) into which the user can position ferromagnetic elements. In such an embodiment, the controller 120 can automatically determine the positions of the ferromagnetic elements about the vessel 105 via wireless communication as discussed above. Alternatively, the user can enter the positions of the ferromagnetic elements about the vessel 105 into a user interface of the controller 120.

In some embodiments in which the ferromagnetic elements are not uniform in size/shape, the controller 120 can also determine the size and/or shape of the ferromagnetic elements via wireless communication. For example, a memory of the controller 120 can store the size/shape of the ferromagnetic element associated with each of a plurality of ferromagnetic identifiers (IDs). Upon receipt of a wireless response from a given ferromagnetic element, the controller 120 can therefore access its memory to determine the size and/or shape of the element. The controller 120 can use this information to control the amount of electromagnetic radiation delivered to the element, which determines the amount and intensity of stirring that occurs.

The controller 120 controls the amount and type of stirring that occurs by controlling which ferromagnetic elements 110 receive targeted radiation from the electromagnetic source 115, the timing (or order) in which the ferromagnetic elements receive the targeted radiation, and/or the intensity of the radiation directed to the ferromagnetic elements (which can change depending on the size, shape, and/or position of the ferromagnetic element). As one example, if the user desires uniform stirring in a single direction, the controller 120 can target the ferromagnetic elements in a pattern that repeatedly traverses a perimeter of the vessel 105 in the same direction.

Using the example of a cylindrical vessel, a ferromagnetic element positioned at 0° (arbitrarily selected) can be targeted first, followed by a ferromagnetic element positioned at 30°, followed by a ferromagnetic element positioned at 60°, followed by a ferromagnetic element positioned at 90°, and so on, until the ferromagnetic element positioned at 0° is again targeted, and the targeting continues in the same circular pattern to induce and maintain the stirring. The timing between targeting of the different ferromagnetic elements can be a fraction of a second (e.g., 0.1 seconds, 0.3 seconds, 0.5 seconds, etc.), or one or more seconds, depending on the desired rate of stirring. The aforementioned example stirs the contents of the vessel in one direction (e.g., clockwise). To reverse the direction of stirring, the order in which the elements are targeted can be reversed such that ferromagnetic element positioned at 0° is targeted first, followed by a ferromagnetic element positioned at 330°, followed by a ferromagnetic element positioned at 300°, followed by a ferromagnetic element positioned at 270°, and so on. Also, the 30° circumferential spacing between ferromagnetic elements is just an example. In alternative implementations, the ferromagnetic elements can be spaced every 5° along the circumference of the vessel, every 10° along the circumference of the vessel, every 20° along the circumference of the vessel, every 45° along the circumference of the vessel, etc.

In some embodiments, a plurality of ferromagnetic elements is positioned at each angular position along the circumference of the vessel 105. For example, a plurality of ferromagnetic elements can be positioned at a 0° position along the circumference of the vessel, another plurality of ferromagnetic elements can be positioned at a 20° position along the circumference of the vessel, another plurality of ferromagnetic elements can be positioned at a 40° position along the circumference of the vessel, and so on. In such an embodiment, the plurality of ferromagnetic elements can be stacked vertically at each angular position. To induce uniform unidirectional stirring, the controller 120 can simultaneously target each of the plurality of ferromagnetic elements at each angular position as the targeting moves around the circumference of the vessel 105. For example, the plurality of ferromagnetic elements at the 0° position can be simultaneously targeted first, the plurality of ferromagnetic elements at the 20° position can be simultaneously targeted second, and so on until the plurality of ferromagnetic elements positioned at 0° is again targeted, and the targeting continues in the same circular pattern to induce and maintain the stirring.

In another embodiment, the targeted heating of ferromagnetic elements can be conducted in a spiral pattern about the circumference of the vessel 105. For example, an uppermost ferromagnetic element positioned at the 0° position can be targeted first, followed by targeting of an ferromagnetic element at the 20° position that is second from the top, followed by targeting of an ferromagnetic element at the 40° position that is third from the top, and so on around the perimeter until the 0° position is again reached. Upon reaching the 0° position again, the same pattern can be repeated. Alternatively, upon reaching the 0° position again, the ferromagnetic element positioned at the 0° position and second from the top can be targeted, followed by targeting of an ferromagnetic element at the 20° position that is third from the top, followed by targeting of an ferromagnetic element at the 40° position that is fourth from the top, and so on. Alternatively, instead of starting at the top, the spiral pattern can be started from the bottommost ferromagnetic element at a given position, and work its way upward as the perimeter of the vessel is traversed.

In another embodiment, the ferromagnetic elements can be targeted randomly by the controller 120. In another embodiment, the ferromagnetic elements can be targeted from top to bottom (or vice versa) about the vessel. For example, a set of uppermost ferromagnetic elements positioned about the perimeter of the vessel (e.g., at 0°, 20°, 40°, 60°, etc. all the way around the vessel) can be simultaneously targeted at a first time, a set of ferromagnetic elements second from the top and positioned about the perimeter of the vessel can be targeted at a second time, a set of ferromagnetic elements third from the top and positioned about the perimeter of the vessel can be targeted at a third time, and so on until the bottommost set of ferromagnetic elements is targeted. The targeting can then work its way back up from the bottommost set of ferromagnetic elements toward the uppermost set of ferromagnetic elements, and the process can continue to repeat to induce and maintain agitation of the contents of the vessel. Alternatively, upon reaching the bottommost set of ferromagnetic elements, the targeting can again return to the uppermost set and work its way downward again.

Figure 2B:
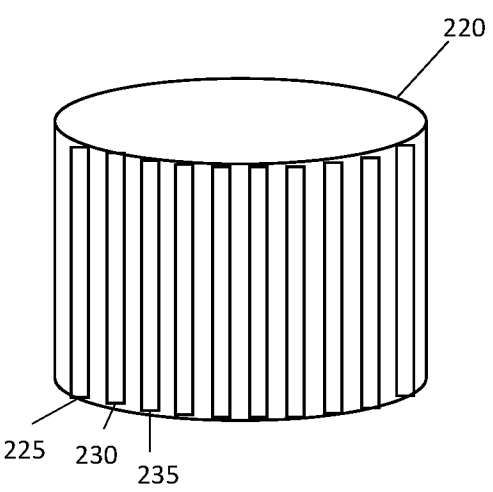
FIG. 2B is a side view of a vessel with a plurality of ferromagnetic elements in accordance with another illustrative embodiment.
Figure 2A:
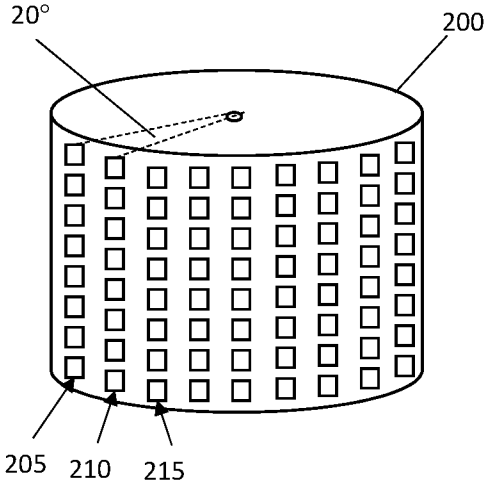
FIG. 2A is a side view of a vessel with a plurality of ferromagnetic elements in accordance with an illustrative embodiment.

FIG. 2A is a side view of a vessel 200 with a plurality of ferromagnetic elements in accordance with an illustrative embodiment. In the embodiment of FIG. 2A, the ferromagnetic elements are positioned in vertical columns about a perimeter of the vessel 200. A first column of ferromagnetic elements 205 is positioned at 0°, a second column of ferromagnetic elements 210 is positioned at 20°, a third column of ferromagnetic elements 215 is positioned at 40°, and so on about the perimeter of the vessel 200. In alternative embodiments, different spacing may be used, such as one column every 10°, one column every 30°, etc. In other embodiments, the spacing between columns can be unequal. The columns of elements can be positioned on an interior surface of the vessel 200, on an exterior surface of the vessel 200, and/or in between inner and outer walls of the vessel 200, depending on the embodiment. Each column includes 8 ferromagnetic elements, although in alternative embodiments a different number of elements may be included such as 1, 2, 4, 16, 32, etc.

FIG. 2B is a side view of a vessel 220 with a plurality of ferromagnetic elements in accordance with another illustrative embodiment. In the embodiment of FIG. 2B, the ferromagnetic elements are in the form of bars vertically positioned about a perimeter of the vessel 220. A first ferromagnetic element 225 is at a first position on the vessel 220, a second ferromagnetic element 230 is at a second position on the vessel 220, a third ferromagnetic element 235 is at a third position on the vessel 220, and so on about the circumference. The ferromagnetic elements can be positioned on an interior surface of the vessel 220, on an exterior surface of the vessel 220, and/or in between inner and outer walls of the vessel 220, depending on the embodiment. In an alternative embodiment, the ferromagnetic elements can be positioned horizontally along the surface(s) of the vessel as opposed to vertically.

Figure 2D:
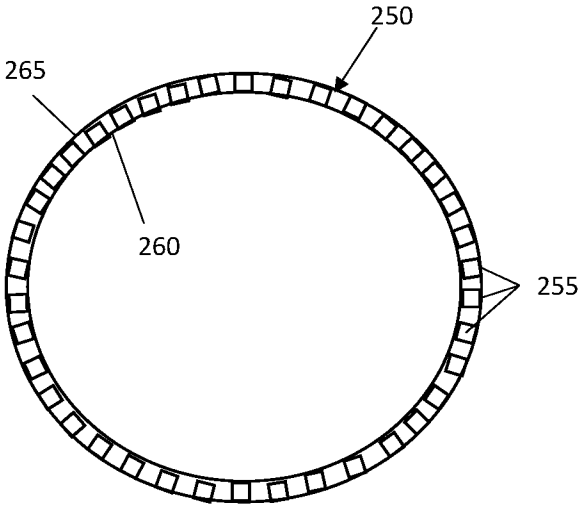
FIG. 2D is a plan view of a vessel with a plurality of ferromagnetic elements positioned between an inner wall and an outer wall of the vessel in accordance with an illustrative embodiment.
Figure 2C:
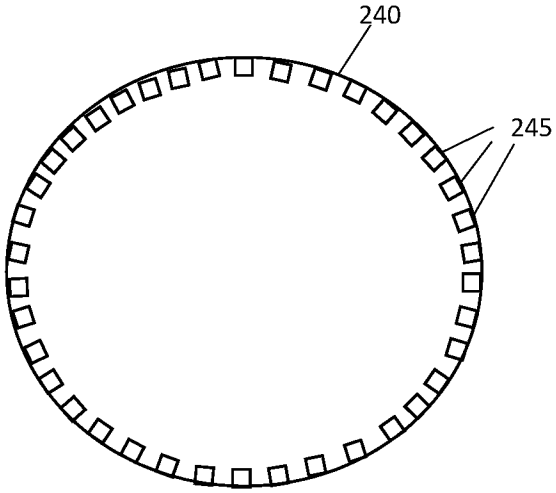
FIG. 2C is a plan view of a vessel with a plurality of ferromagnetic elements positioned on an interior surface in accordance with an illustrative embodiment.
Figure 2F:
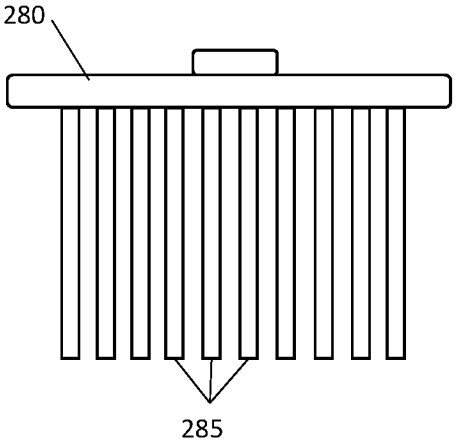
FIG. 2F is a side view of a lid for a vessel that includes a plurality of ferromagnetic elements mounted thereto in accordance with an illustrative embodiment.
Figure 2E:
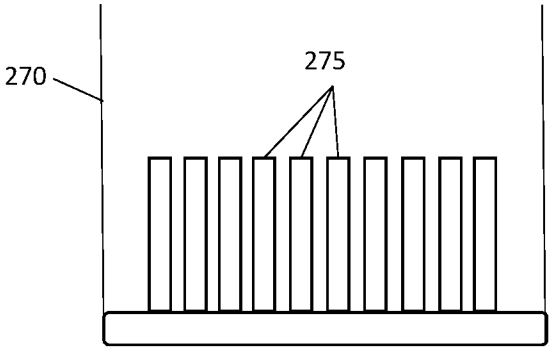
FIG. 2E is a cross-sectional side view of a vessel that includes ferromagnetic elements extending from a bottom wall of the vessel in accordance with an illustrative embodiment.

FIG. 2C is a plan view of a vessel 240 with a plurality of ferromagnetic elements 245 positioned on an interior surface in accordance with an illustrative embodiment. FIG. 2D is a plan view of a vessel 250 with a plurality of ferromagnetic elements 255 positioned between an inner wall 260 and an outer wall 265 of the vessel 250 in accordance with an illustrative embodiment. FIG. 2E is a cross-sectional side view of a vessel 270 that includes ferromagnetic elements 275 extending from a bottom wall of the vessel 270 in accordance with an illustrative embodiment. Alternatively, one or more ferromagnetic elements may also be positioned in slots formed between an interior bottom wall of the vessel and an exterior bottom wall of the vessel. FIG. 2F is a side view of a lid 280 for a vessel that includes a plurality of ferromagnetic elements 285 mounted thereto in accordance with an illustrative embodiment.

While FIGS. 2A-2F depict various configurations and positions of ferromagnetic elements about a vessel, it is to be understood that other configurations are also envisioned. For example, different numbers and/or positions of ferromagnetic elements may be used. In one embodiment, one or more portions of vessel may not include any ferromagnetic elements. In some embodiments, the vessel can have two or more chambers, and each of the chambers can have a different pattern of ferromagnetic elements. For example, a first chamber may include a plurality of elements about its perimeter and a second chamber may include no ferromagnetic elements. In another embodiment, a spiral pattern or a plurality of circular patterns of ferromagnetic elements can be positioned on a bottom surface, side surface, or in between walls of the vessel. Also, different sizes and/or shapes of ferromagnetic elements can be used on the same vessel.

As described herein, in some embodiments the vessel can be modular such that the user is able to position ferromagnetic elements in desired positions about the vessel via the use of hooks or other appendages that extend from a surface of the vessel, via a stand that rests on a bottom of the vessel, via slots formed between side/bottom walls of the vessel, etc.

Figure 3:
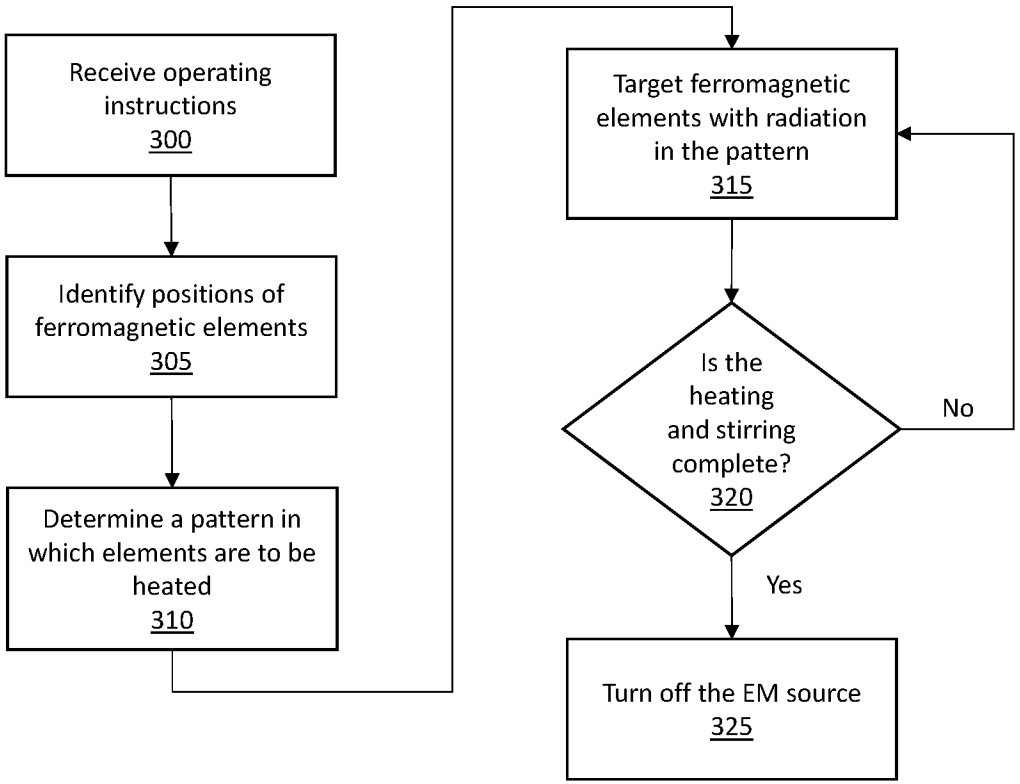
FIG. 3 is a flow diagram depicting operations performed by a self-stirring induction system in accordance with an illustrative embodiment.

FIG. 3 is a flow diagram depicting operations performed by a self-stirring induction system in accordance with an illustrative embodiment. In alternative embodiments, fewer, additional, and/or different operations may be performed. Additionally, the use of a flow diagram is not meant to be limited with respect to the order of operations performed. In an operation 300, the system receives operating instructions from a user. The operating instructions can include an instruction to turn the system on (i.e., pressing/turning an on/off switch), an amount of desired stirring (e.g., gentle, intermediate, active, etc.), a type of stirring to be performed (e.g., uniform and unidirectional, multi-directional, randomly, etc.), a temperature setting, etc. The operating instructions can be received from a user via a user interface of the system controller.

In an operation 305, the system identifies positions of the ferromagnetic elements about the vessel (and relative to the electromagnetic source). In one embodiment, the positions of the elements can be static and can be stored in a memory of the controller. In another embodiment, a user can provide the positions of the ferromagnetic elements to the controller through an interface and based on a desired arrangement that the user has constructed by mounting elements to various positions of the vessel. In another embodiment, the controller can communicate with a transceiver (e.g., tag) in each of the ferromagnetic elements to determine the positions of the elements as described herein.

In an operation 310, the system determines a pattern in which the ferromagnetic elements are to be heated. The pattern can be determined based in part on the desired amount and type of stirring to be performed, the temperature setting, the positions of the ferromagnetic elements, the size/shape of the ferromagnetic elements, etc. In one embodiment, the pattern can be received as an operating instruction from the user. The pattern can be a unidirectional circular pattern, a bi-directional circular pattern, a spiral pattern, a top to bottom (of the vessel) pattern, a bottom to top (of the vessel) pattern, a random pattern, a pattern that targets only certain areas of the vessel, etc. The system can also determine the intensity of EM radiation that is to be directed to each ferromagnetic element, and the intensity used can vary between the different elements. The system can also determine the amount of time to target each ferromagnetic element to achieve the desired type/amount of stirring and the desired level of heating.

As an example, gentle stirring at high heat can be achieved by simultaneously targeting a plurality of elements with high intensity radiation for longer periods of time. Active stirring at high heat can be achieved by targeting individual elements with high intensity radiation for shorter periods of time (i.e., before moving on to the next element) in a pattern that traverses the perimeter of the vessel. The intensity of radiation can also be adjusted on an element by element basis to account for element size/shape, and larger elements can be targeted with higher intensity radiation than smaller elements, in some embodiments. Alternatively, the same amount of radiation can be used to target all sizes/shapes of ferromagnetic elements to achieve the desired stirring (i.e., larger elements will result in less stirring than smaller elements, when both are targeted with the same radiation).

In an operation 315, the system targets the ferromagnetic elements with electromagnetic radiation in the determined pattern. Specifically, the controller causes the electromagnetic source to target individual ferromagnetic elements or groups of ferromagnetic elements sequentially in the determined pattern. As discussed above, the intensity of radiation used to target the elements can be the same for all elements, or vary between different elements, depending on the implementation. The targeting of the ferromagnetic elements causes the elements to heat up via induction, which causes the contents of the vessel to heat up via direct or indirect contact with the elements. The targeting of the ferromagnetic elements also causes agitation (i.e., stirring) of the contents to occur via convection currents that occur responsive to the heating. The pattern used dictates the type and amount of stirring that occurs.

In an operation 320, a determination is made regarding whether the heating and stirring is complete. The determination can be based on expiration of a timer, reaching a desired temperature (through use of a temperature probe positioned in the vessel and in communication with the controller), receipt of a subsequent user instruction to stop the process, etc. If the determination is negative (heating and stirring is not complete), the system continues to target the ferromagnetic elements with radiation in the operation 315. If the determination is positive (heating and stirring is complete), the EM source is turned off in an operation 325.

Figure 4:
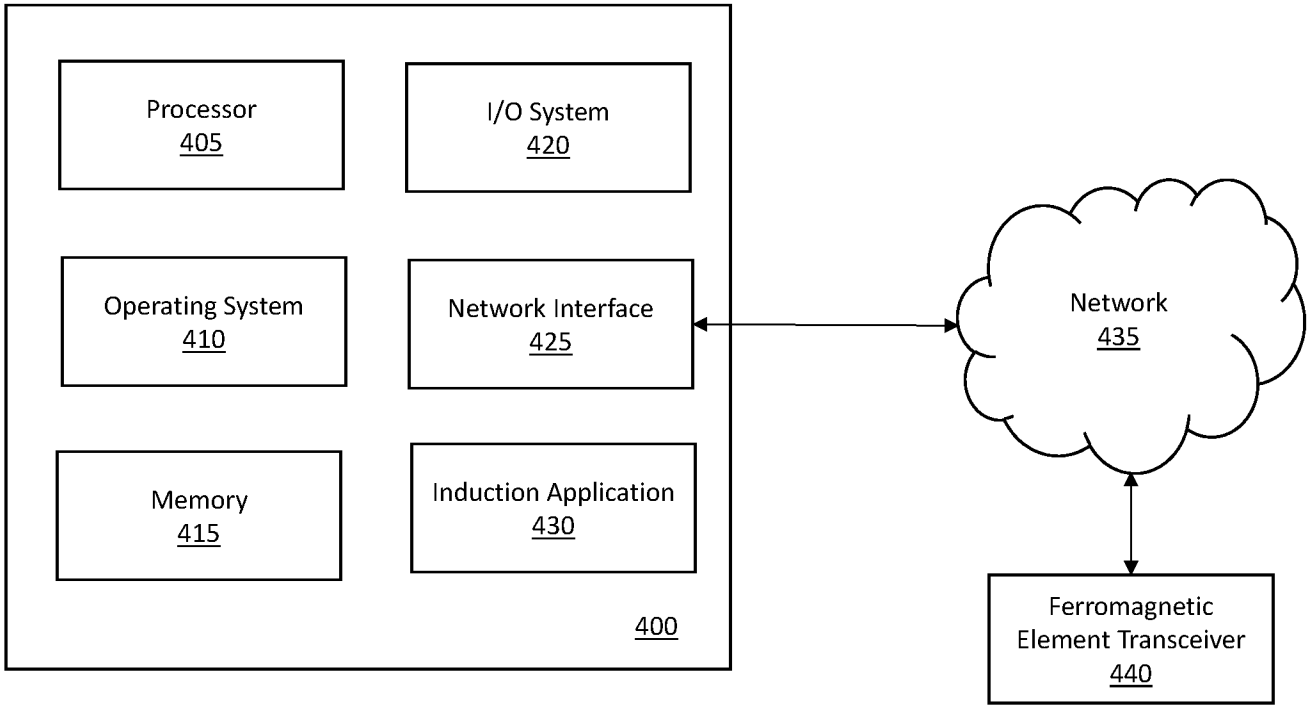
FIG. 4 is a block diagram of a system controller in the form of a computing device that is in communication with a network in accordance with an illustrative embodiment.

FIG. 4 is a block diagram of a system controller in the form of a computing device 400 that is in communication with a network 435 in accordance with an illustrative embodiment. The computing device 400 can, for example, be the controller 120 depicted in FIG. 1. The computing device 400 includes a processor 405, an operating system 410, a memory 415, an input/output (I/O) system 420, a network interface 425, and an induction application 430. In alternative embodiments, the computing device 400 may include fewer, additional, and/or different components. The components of the computing device 400 communicate with one another via one or more buses or any other interconnect system. The computing device 400 can be any type of networked computing device such as a dedicated cooktop computer, a laptop computer, desktop computer, smart phone, tablet, etc.

The processor 405 can be any type of computer processor known in the art, and can include a plurality of processors and/or a plurality of processing cores. The processor 405 can include a controller, a microcontroller, an audio processor, a hardware accelerator, a digital signal processor, etc. Additionally, the processor 405 may be implemented as a complex instruction set computer processor, a reduced instruction set computer processor, an x86 instruction set computer processor, etc. The processor is used to run the operating system 410, which can be any type of operating system.

The operating system 410 is stored in the memory 415, which is also used to store programs, user data, network and communications data, peripheral component data, the induction application 430, and other computer-readable operating instructions. The memory 415 can be one or more memory systems that include various types of computer memory such as flash memory, random access memory (RAM), dynamic (RAM), static (RAM), a universal serial bus (USB) drive, an optical disk drive, a tape drive, an internal storage device, a non-volatile storage device, a hard disk drive (HDD), a volatile storage device, etc.

The I/O system 420 is the framework which enables users and peripheral devices to interact with the computing device 400. The I/O system 420 can include a mouse, a keyboard, one or more displays, a speaker, a microphone, etc. that allow the user to interact with and control the computing device 400. The I/O system 420 also includes circuitry and a bus structure to interface with peripheral computing devices such as power sources, USB devices, peripheral component interconnect express (PCIe) devices, serial advanced technology attachment (SATA) devices, high definition multimedia interface (HDMI) devices, proprietary connection devices, etc.

The network interface 425 includes transceiver circuitry that allows the computing device to transmit and receive data to/from other devices such as a ferromagnetic element transceiver 440. The network interface 425 enables communication through a network 435, which can be one or more communication networks. The network 435 can include a cable network, a fiber network, a cellular network, a wi-fi network, a landline telephone network, a microwave network, a satellite network, etc. The network interface 425 also includes circuitry to allow device-to-device communication such as Bluetooth® communication.

The induction application 430 can include software in the form of computer-readable instructions which, upon execution by the processor 405, performs any of the various operations described herein such as processing user instructions, identifying the positions of ferromagnetic elements, determining a pattern with which to target ferromagnetic elements, controlling an EM source to target the ferromagnetic elements in a determined pattern, etc. The induction application 430 can utilize the processor 405 and/or the memory 415 as discussed above. In an alternative implementation, the induction application 430 can be remote or independent from the computing device 400, but in communication therewith.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more."

The foregoing description of illustrative embodiments of the invention has been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. A self-stirring induction system, the system comprising:

a vessel that includes a plurality of ferromagnetic elements mounted to a surface of the vessel, wherein each ferromagnetic element in the plurality of ferromagnetic elements includes a transmitter configured to transmit an identifier that uniquely identifies the ferromagnetic element;

an electromagnetic radiation source that is positioned to deliver electromagnetic radiation to the plurality of ferromagnetic elements; and a controller in communication with the electromagnetic radiation source, wherein the controller is configured to:

determine, based at least in part on a desired amount or type of stirring, a pattern in which to heat the plurality of ferromagnetic elements, wherein the pattern includes a direction and an order in which to sequentially heat the plurality of ferromagnetic elements;

determine, based at least in part on the desired amount or type of stirring, an intensity of the electromagnetic radiation to direct to each ferromagnetic element in the plurality of ferromagnetic elements;

cause the electromagnetic radiation source to target each of the plurality of ferromagnetic elements with radiation in the determined pattern and at the determined intensity to induce a convection current in contents of the vessel such that the desired amount or type of stirring occurs.

2. The system of claim 1, further comprising a user interface of the controller, wherein the user interface is configured to receive the desired amount or type of stirring from a user.

3. The system of claim 1, wherein the controller is configured to identify a position of each ferromagnetic element in the plurality of ferromagnetic elements.

4. The system of claim 3, wherein the controller identifies the positions based on information received from a user.

5. The system of claim 3, wherein the controller is configured to receive a signal from each of the plurality of ferromagnetic elements that includes the identifier, and wherein the controller determines the positions based on the signals.

6. The system of claim 3, wherein the controller stores the identifier and the position of the ferromagnetic element associated with the identifier in the memory.

7. The system of claim 1, wherein the vessel includes an inner side wall and an outer side wall, and wherein the plurality of ferromagnetic elements are positioned in between the inner side wall and the outer side wall.

8. The system of claim 1, wherein the vessel includes an inner bottom wall and an outer bottom wall, and wherein the plurality of ferromagnetic elements are positioned in between the inner bottom wall and the outer bottom wall.

9. The system of claim 1, wherein the plurality of ferromagnetic elements are positioned on an interior wall of the vessel.

10. The system of claim 1, wherein the plurality of ferromagnetic elements are positioned on an exterior wall of the vessel.

11. The system of claim 1, wherein the pattern traverses a perimeter of the vessel, and wherein the direction comprises a clockwise or counterclockwise direction around the perimeter of the vessel.

12. The system of claim 1, wherein the pattern comprises a spiral pattern, a top to bottom pattern, or a bottom to top pattern.

13. The system of claim 1, further comprising a cover for the vessel, wherein one or more of the plurality of ferromagnetic elements is mounted to the cover.

14. A method for self-stirring, the method comprising:

receiving, by a processor of a controller, a desired amount or type of stirring to perform on contents of a vessel;

receiving, by the controller and from a transmitter of a ferromagnetic element, a unique identifier that uniquely identifies the ferromagnetic element within a plurality of ferromagnetic elements;

determining, by the processor of the controller and based at least in part on the desired amount or type of stirring, a pattern in which to heat the plurality of ferromagnetic elements that are positioned about and mounted to a surface of the vessel, wherein the pattern includes a direction and an order in which to sequentially heat the plurality of ferromagnetic elements;

determining, by the processor of the controller and based at least in part on the desired amount or type of stirring, an intensity of the electromagnetic radiation to direct to each ferromagnetic element in the plurality of ferromagnetic elements; and causing, by the processor, an electromagnetic radiation source to target each of the plurality of ferromagnetic elements with radiation in the determined pattern and at the determined intensity to induce a convection current in the contents of the vessel such that the desired amount or type of stirring occurs.

15. The method of claim 14, further comprising identifying, by the processor, a position of each ferromagnetic element in the plurality of ferromagnetic elements.

16. The method of claim 15, wherein the processor determines the positions based on the unique identifier received from each ferromagnetic element in the plurality of ferromagnetic elements.

17. The method of claim 14, wherein the pattern traverses a perimeter of the vessel, and wherein the direction comprises a clockwise or counterclockwise direction around the perimeter of the vessel.

18. The method of claim 14, further comprising repeating, by the processor, the determined pattern until a termination instruction is received.

19. The method of claim 14, further comprising receiving, by the processor, an operating instruction that specifies the desired amount or type of stirring to perform on contents of the vessel.

* * * * *